US007028584B1

(12) United States Patent
Gracy

(10) Patent No.: US 7,028,584 B1
(45) Date of Patent: Apr. 18, 2006

(54) SHINGLE REMOVER WITH REPLACEMENT BLADE

(76) Inventor: Mark S. Gracy, 5090 Carnousti Dr., Presto, PA (US) 15142

( * ) Notice: Subject to any disclaimer, the term of this patent is extended or adjusted under 35 U.S.C. 154(b) by 0 days.

(21) Appl. No.: 10/918,784

(22) Filed: Aug. 13, 2004

(51) Int. Cl.
*E04D 15/02* (2006.01)

(52) U.S. Cl. ..... 81/45; 30/169

(58) Field of Classification Search ..... 81/45; 30/169, 172
See application file for complete search history.

(56) References Cited

U.S. PATENT DOCUMENTS 4,466,188 A 8/1984 Svendsgaard
5,280,676 A 1/1994 Fieni
5,996,231 A * 12/1999 Roche et al. ..... 30/169
6,105,469 A 8/2000 Gracy
6,467,377 B1 * 10/2002 Kersting ..... 81/45
6,681,658 B1 * 1/2004 O'Neal et al. ..... 81/45

* cited by examiner

*Primary Examiner*—David B. Thomas

(57) ABSTRACT

A hand tool is provided for the removal of roofing shingles. The tool has a handle and a first blade extending from the handle. The first blade comprises a metal plate having a top surface and a bottom surface, and a leading edge facing away from the handle and a trailing edge adjacent the handle. The first blade has a plurality of teeth exending outwardly from the leading edge of the first blade. A second blade is attached to the first blade on the top surface of the first blade. The second blade is movable from a first position remote from the teeth of said first blade to a second position in which a portion of said second blade extends outwardly beyond the teeth of said first blade.

6 Claims, 3 Drawing Sheets

SHINGLE REMOVER WITH REPLACEMENT BLADE

FIELD OF THE INVENTION

The present invention relates to a hand tool for removing roofing shingles, and particularly to such a tool that has a dual purpose replacement blade that can be stored on the tool.

BACKGROUND OF THE INVENTION

Tools for removing roofing shingles typically have a handle and a blade attached to the handle. The blade generally has spaced teeth for removing nails and roof shingles. When the blade wears to the point that it no longer can be used, the entire tool, i.e. the handle and blade are discarded or thrown out.

A typical shingle remover is shown in U.S. Pat. No. 4,466,188 to Svendagaard. A more recent shingle remover is shown in my U.S. Pat. No. 6,105,469. Finally, a shingle remover with a replaceable blade portion attached to the handle portion is shown in U.S. Pat. No. 5,280,676 to Fieni. The latter reference does not disclose a replacement blade that can be stored on the tool itself.

There is a need for a shingle remover tool that provides a replaceable blade in a readily accessible position on the tool itself in order to facilitate rapid replacement of the blade. There is also a need for a roofing remover tool that has a dual purpose blade that provides for the accomplishment of more than one function.

DISCLOSURE OF THE INVENTION

According to the present invention a hand tool is provided for the removal of roofing shingles. The tool has a handle and a first blade extending from the handle. The first blade comprises a metal plate having a top surface and a bottom surface, and a leading edge facing away from the handle and a trailing edge adjacent the handle. The first blade has a plurality of teeth extending outwardly from the leading edge of the first blade. A second blade is attached to the first blade on the top surface of the first blade. The second blade is movable from a first position remote from the teeth of said first blade to a second position in which a portion of said second blade extends outwardly beyond the teeth of said first blade.

In a preferred form of the invention, the second blade has a plurality of teeth on a first edge of said second blade and a straight edge on a second edge of said second blade opposite said first edge thereof. Said second blade is reversible so that either the first edge or the second edge of said second plate may be positioned so as to extend beyond the teeth of said first plate.

DESCRIPTION OF THE PREFERRED EMBODIMENT

Figure 1:
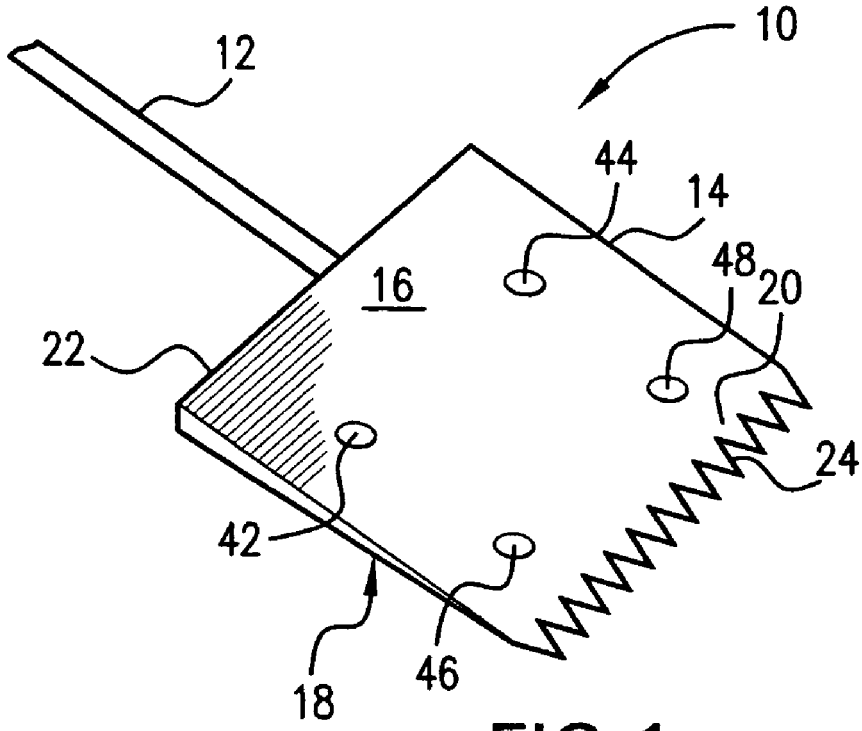
FIG. 1 is a schematic perspective view of the tool of the present invention showing a handle with a first blade extending from said handle.
Figure 2:
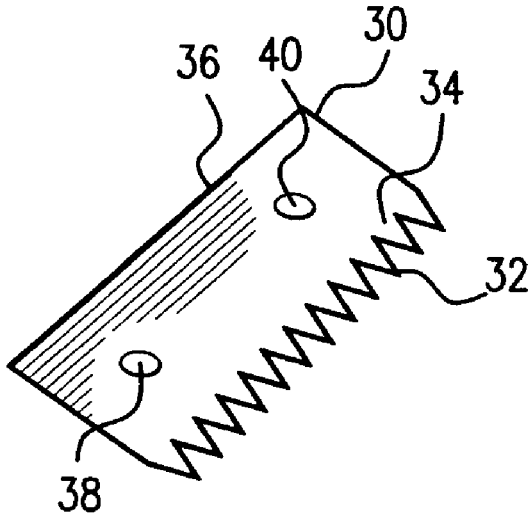
FIG. 2 is a plan view of a second blade adapted to be stored on the top surface of the tool shown in FIG. 1.
Figure 3:
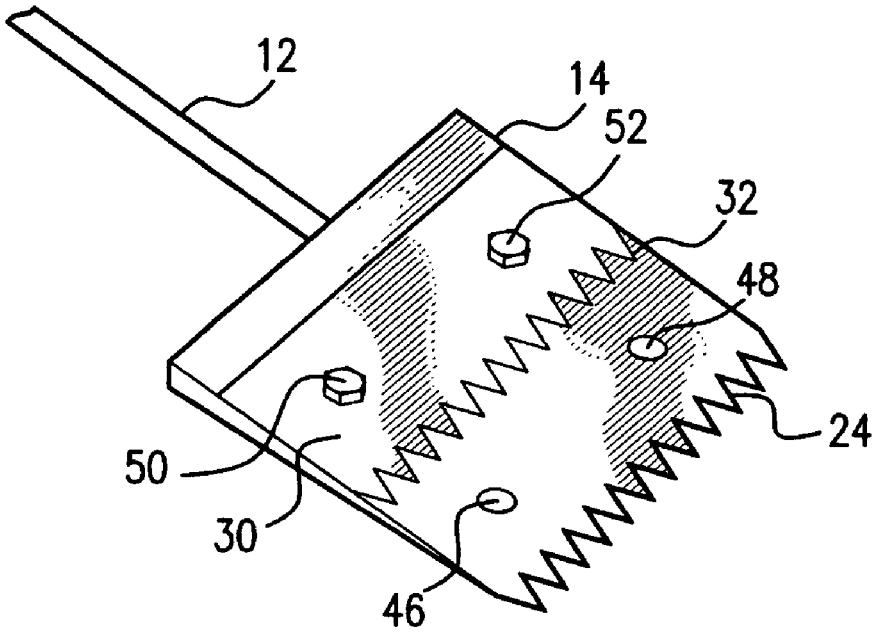
FIG. 3 is a schematics perspective view of the tool of FIG. 1 with the second blade stored in a first position on the top surface of the tool.
Figure 4:
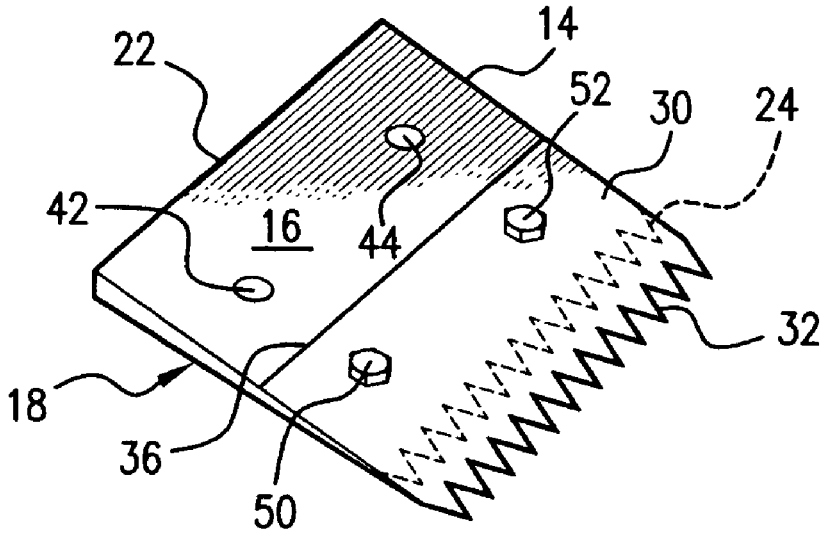
FIG. 4 is a schematic perspective view of the first blade of the tool of the invention with the second blade attached to the first blade in a second position such that the teeth of the second blade extend outwardly beyond the teeth of the first blade.
Figure 5:
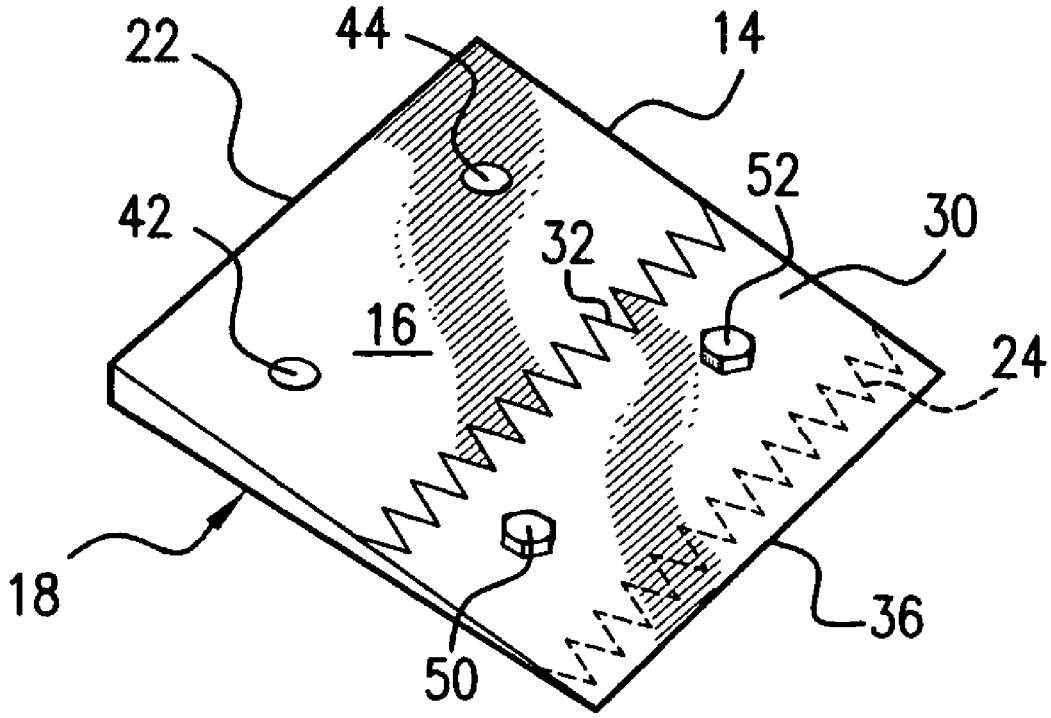
FIG. 5 is a schematic perspective view of the first blade of the tool of the invention with the second blade attached in a second position with a straight edge of said second blade extending outwardly beyond the teeth of said first blade.

Referring to FIG. 1 a roofing removal tool 10 comprises a handle 12 with a first blade 14 extending from the handle. First blade 14 has a top surface 16, a bottom surface 18, a leading edge 20 and a trailing edge 22, with a plurality of spaced teeth 24 extending outwardly from leading edge 20. A second blade 30 (FIG. 2) is provided for replacement of the first blade and has a plurality of teeth 32 along a first edge 34 and a straight blade edge 36 opposite said first edge 34. Said second blade is adapted to be stored in a first position remote from leading edge 20 on the top surface 16 of first blade 14, as shown in FIG. 3. Preferably, second blade 30 (FIG. 2) has a plurality of holes 38 and 40 that can be mateably aligned with either a first plurality of holes 42 and 44 or a second plurality of holes 46 and 48 in first blade 14. Preferably second blade 30 can be attached to the first blade by inserting bolts 50 and 52 through holes 38 and 40 in said second blade and through either holes 42 and 44 or holes 46 and 48 in the first blade when said holes in said first and second blade are mateably aligned. Nuts (not shown) preferably are threaded onto the threaded end of bolts 50 and 52 to secure the second blade in position on the top surface of the first blade. When the first blade wears out, the second blade may be moved to a second position as shown in FIG. 4. In the second position, holes 38 and 40 of the second blade are mateably aligned with holes 46 and 48 in the first blade. Again the second blade is secured in the second position by bolts inserted through the holes with nuts threaded onto the threaded end of the bolts. FIG. 4 shows second blade 30 attached to first blade 14 in the second position with teeth 32 of the second blade extending beyond the teeth of first blade 14. FIG. 5 shows second blade 30 attached to first blade 14 in the second position, except said second blade is reversed so that straight blade edge 36 extends beyond the teeth of first blade 14. The straight blade edge may be used for scraping glue, drywall mud, plaster, carpet, ice or flooring materials. The straight edge may be sharpened as said edge wears or becomes dull. Thus, a roofing removal tool is provided that has a dual purpose blade that can be stored on the roofing removal tool and which is readily accessible and movable from a storage position to a cutting or action position.

The invention claimed is:

1. A tool for removing roofing shingles, comprising:

a handle with a first blade extending therefrom, said first blade having a top surface and a bottom surface, said first blade having a leading edge extending outwardly from said handle and a trailing edge adjacent to said handle, a second blade adapted to be stored in a first position on the top surface of said first blade, said second blade having a first edge with a plurality of spaced teeth extending outwardly from said first edge and a second edge comprising a straight edge, said second blade being movable from said first position to a second position in which one of said first and second edges extend outwardly beyond the leading edge of said first blade.

2. The tool of claim 1 wherein said first blade has a plurality of holes defining a first position on the top surface thereof and a plurality of holes defining a second position on said top surface, and said second blade has a plurality of holes capable of being mateably aligned with either said holes defining a first position on the top surface of said first blade or said holes defining said second position on said top surface, said second blade being adapted to be attached in either of said positions by connectors inserted through the holes of said first and said second blade.

3. A tool for removing roofing shingles, comprising:

a handle with a first blade extending therefrom, said first blade having a top surface and a bottom surface, said first blade having a leading edge extending outwardly from said handle and a trailing edge adjacent to said handle, a second blade adapted to be stored in a first position on the top surface of said first blade, said second blade having a first edge with a plurality of spaced teeth extending outwardly from said first edge, said second blade having a second straight edge opposite said first edge, said second blade being movable from said first position to a second position in which said plurality of spaced teeth of said second blade extend outwardly beyond the leading edge of said first blade, said second blade being reversible and movable from said first position to said second position in which said second straight edge extends outwardly beyond the leading edge of said first blade.

4. The tool of claim 3 wherein said first blade has a plurality of holes defining a first position on the top surface thereof and a plurality of holes defining a second position on said top surface, and said second blade has a plurality of holes capable of being mateably aligned with either said holes defining a first position on the top surface of said first blade or said holes defining said second position on said top surface, said second blade being adapted to be attached in either of said positions by connectors inserted through the holes of said first and said second blade.

5. The tool of claim 1 wherein the leading edge of said first blade has a plurality of teeth extending outwardly from said leading edge.

6. The tool of claim 3 wherein the leading edge of said first blade has a plurality of teeth extending outwardly from said leading edge.

* * * * *